US006402467B1

(12) United States Patent
Godichon et al.

(10) Patent No.: US 6,402,467 B1
(45) Date of Patent: Jun. 11, 2002

(54) COMPOSITE MATERIAL CENTRIFUGAL WHEEL

(75) Inventors: Alain Francois Emile Godichon, Saint-Remy; Sylvain Georges Raymond Guillemin, Chalon-sur-Saône, both of (FR)

(73) Assignee: ABB Solyvent-Ventec (FR)

( * ) Notice: Subject to any disclaimer, the term of this patent is extended or adjusted under 35 U.S.C. 154(b) by 0 days.

(21) Appl. No.: 09/623,787

(22) PCT Filed: Mar. 11, 1999

(86) PCT No.: PCT/FR99/00536

§ 371 (c)(1),
(2), (4) Date: Sep. 8, 2000

(87) PCT Pub. No.: WO99/46511

PCT Pub. Date: Sep. 16, 1999

(30) Foreign Application Priority Data

Mar. 11, 1998 (FR) ..... 98 03208

(51) Int. Cl.[7] ..... F01D 5/14
(52) U.S. Cl. ..... 415/200; 416/230
(58) Field of Search ..... ; 415/198.1, 199.1, 415/200, 217.1; 416/144, 145, 185, 214 R, 214 A, 219 R, 219 A, 241 A, 230, 186 R; F04D 29/02, 29/28

(56) References Cited

U.S. PATENT DOCUMENTS

| | | | | |
|---|---|---|---|---|
| 3,144,204 A | * | 8/1964 | Bohanon | 230/134 |
| 4,428,717 A | * | 1/1984 | Catterfeld | 416/186 R |
| 5,464,325 A | | 11/1995 | Albring et al. | 416/185 |
| 5,632,601 A | | 5/1997 | Bodmer et al. | 416/223 B |
| 5,800,128 A | | 9/1998 | Bodmer et al. | 416/183 |
| 5,845,398 A | | 12/1998 | Maumus et al. | 29/889.21 |

FOREIGN PATENT DOCUMENTS

| | | |
|---|---|---|
| DE | 26 10 362 A | 9/1977 |
| FR | 2 504 209 A | 10/1982 |
| FR | 2 631 083 A | 11/1989 |

* cited by examiner

*Primary Examiner*—Edward K. Look
*Assistant Examiner*—Richard Edgar
(74) *Attorney, Agent, or Firm*—Lerner, David, Littenberg, Krumholz & Mentlik, LLP

(57) ABSTRACT

An impeller is disclosed including a number of vanes, first and second coaxial disks formed from composite material on opposite sides of the vanes to fix the vanes in position, so that the impeller can rotate on an axis of rotation, and at least one reinforcing collar disposed coaxially with and adjacent to the axis of rotation to provide an interior collar, the at least one reinforcing collar comprising reinforcing fibers, such as carbon fibers.

22 Claims, 6 Drawing Sheets

COMPOSITE MATERIAL CENTRIFUGAL WHEEL

FIELD OF THE INVENTION

The present invention relates to the field of blower wheels or impellers formed from composite materials and which can be present in any industrial ventilation equipment or installation.

More particularly, the present invention relates to a centrifugal or mixed flow impeller formed from composite materials comprising a series of vanes supported by an annular support structure formed from composite materials, and at least one reinforcing collar based on filament windings including reinforcing fibers, for example carbon fibers, the collar being disposed coaxially with and close to the rotational axis of the impeller to form an interior collar.

Still more particularly, the present invention relates to a composite material disk for a centrifugal or mixed flow impeller.

BACKGROUND OF THE INVENTION

Impellers are routinely produced from composite materials, and are generally intended for use in a variety of industrial ventilating installations, such as axial flow air compressors or turbine engines.

In such known devices, the impeller is produced by injecting resin into a suitable mold, the mold already containing composite material fibers which are intended to reinforce the entire structure of the impeller. In this type of known technique, the centrifugal impeller obtained by injection molding constitutes a unitary assembly including: the axle, an annular support structure and the ventilation vanes disposed radially about that structure.

The disadvantages of this technique for producing centrifugal impellers lie primarily in the difficulty in holding the reinforcing fibers in the desired configuration during the injection operation. As a result, the production technique is complicated and difficult, multiplying production safety. measures and leading to the production of centrifugal impellers with reduced strength, in particular as regards the ventilation vanes.

Finally, resin injection is an expensive production technique as the fibers currently in use must in general be manually disposed in the mold. A partial solution to these problems that has been proposed is to improve methods for producing centrifugal impellers by injecting resin by attempting to reinforce the strength of the impellers so produced. In particular, reinforcing the resistance of the ventilation vanes to centrifugal loads and reinforcing their bond with the annular support structure has been proposed. The proposed improvements have consisted of producing reinforced zones or collars formed by filament windings of carbon fibers located at the base of the vanes and at their periphery.

Such measures have tended to reinforce the mechanical strength of certain zones of the impeller but have failed to provide a general solution to the problem of the mechanical strength of the impeller assembly as a whole. Further, the question of high production costs remains unanswered.

One of the objects of the present invention is to provide a novel centrifugal impeller produced from composite materials which overcomes the various disadvantages discussed above and the construction of which guarantees correct behavior as regards centrifugal forces, and controlled stiffness and deformation.

Another object of the present invention is to provide a novel centrifugal impeller of composite material which is capable of withstanding high peripheral rotational speeds and is formed from cheap, light unitary materials.

Yet another object of the present invention is to provide a novel centrifugal impeller of composite material in which the various elements of the composite materials of the impeller combine to contribute to the lightness and general strength of the impeller.

Yet another object of the present invention is to provide a novel centrifugal impeller of composite material with improved and easier balance.

Yet another object of the present invention is to provide a novel centrifugal impeller of composite material that is easier to balance in an improved manner.

SUMMARY OF THE INVENTION

In accordance with the present invention, these and other objects have now been realized by the invention of an impeller comprising a plurality of vanes, first and second coaxial disks formed from composite material on opposite sides of the plurality of vanes for fixing the vanes in position, whereby the impeller can rotate about an axis of rotation, and at least one reinforcing collar disposed coaxially with and adjacent to the axis of rotation to provide an interior collar therefor, the at least one reinforcing collar comprising reinforcing fibers. In a preferred embodiment, the reinforcing fibers comprise carbon fibers.

In accordance with one embodiment of the impeller of the present invention, each of the first and second coaxial disks includes a pair of outer layers and an intermediate zone, the intermediate zone comprising material having improved compressive strength. In a preferred embodiment, each of the pair of outer layers comprises an inner skin layer facing the vanes and an outer skin layer facing away from the vanes. Preferably, each of the inner skin layers includes a decreasing thickness moving in a direction radially outward from the axis of rotation and each of the outer skin layers includes a substantially constant thickness.

In accordance with one embodiment of the impeller of the present invention, the intermediate zone comprises a solid material.

In accordance with another embodiment of the impeller of the present invention, the intermediate zone comprises a hollow core material having a honeycomb structure.

In accordance with another embodiment of the impeller of the present invention, each of the outer skin layers and each of the inner skin layers comprises a stacked plurality of layers of synthetic fiber material. In a preferred embodiment, each of the stacked plurality of layers comprises a plurality of radial sections, the plurality of radial sections each being partially overlapping with its adjacent radial sections.

In accordance with another embodiment of the impeller of the present invention, the at least one reinforcing collar comprises first and second reinforcing collars associated with the first and second coaxial disks, respectively.

In accordance with another embodiment of the impeller of the present invention, the at least one reinforcing collar is at least partially surrounded by at least one of the outer skin layers and at least one of the inner skin layers.

In accordance with another embodiment of the impeller of the present invention, the impeller includes a first peripheral collar axially and peripherally disposed on the first coaxial disk and a second peripheral collar axially and peripherally disposed on the second coaxial disk, each of the first and second peripheral collars comprising reinforcing fibers. In a preferred embodiment, the reinforcing fibers comprise carbon fibers. Preferably, each of the pair of outer layers comprises an inner skin layer facing the vanes and an outer skin layer facing away from the vanes. In a preferred embodiment, each of the first and second peripheral collars is at least partially surrounded by at least one of outer skin layers and at least one of the inner skin layers.

In accordance with another embodiment of the impeller of the present invention, the impeller includes a first annular balancing zone peripherally disposed inwardly from the first peripheral collar and a second annular balancing zone peripherally disposed inwardly from the second peripheral collar, the first and second annular balancing zones including a perforatable material. In a preferred embodiment, the perforatable material comprises a synthetic foam.

In accordance with another embodiment of the impeller of the present invention, the plurality of vanes comprises a composite material. Preferably, the plurality of vanes have an H-shaped cross-sectional configuration. In a preferred embodiment, the plurality of vanes include an attack edge, a pressure face and a trailing edge with respect to the direction of rotation of the impeller, and the impeller includes metal guard members for the plurality of vanes comprising a peg disposed on the attack edge, and a first shim affixed to the pressure face and covering the attack edge of the plurality of vanes. Preferably, the first shim also covers the trailing edge of the plurality of vanes.

In accordance with another embodiment of the impeller of the present invention, the impeller includes a second shim affixed to one of the first and second coaxial disks and including a flange disposed on the pressure face of the plurality of vanes.

In accordance with another embodiment of the impeller of the present invention, the first and second coaxial disks include a plurality of depressions adapted to receive the plurality of vanes in order to facilitate the positioning thereof.

The objects of the present invention are achieved by providing a centrifugal impeller produced from composite materials comprising a series of vanes supported by an annular support structure of composite material and at least one reinforcing collar based on filament windings including reinforcing fibers, for example carbon fibers, disposed coaxially with and close to the rotational axis of the impeller to form an interior collar, and in which the support structure comprises at least two coaxial disks mounted one against the other to clamp and fix the vanes.

BRIEF DESCRIPTION OF THE DRAWINGS

Further details and advantages of the present invention will be more fully appreciated by reference to the following detailed description, which, in turn, refers to the drawings, in which.

DETAILED DESCRIPTION

The following detailed description makes particular reference to a centrifugal impeller produced from composite materials for mounting and integrating into a ventilation installation for mechanical vapor compression (MVC).

However, it is clear that the centrifugal impeller of the present invention can be used in any ventilation installation and is not limited to use in MVC installations.

Thus, while the heat energy recovered in MVC installations and processes can be used in processes such as: concentration by evaporation, crystallization by evaporation, distillation, energy recovery from liquid or gas waste, drying superheated vapors, or cooking-drying of animal by-products, the impeller of the present invention can also be applied, by way of non limiting example, to any primary air ventilator for a fluidized bed process, or in any aeration ventilator for water treatment, or in any centrifugal compression machine whatever its ventilation capacity.

Preferably, and in a non-limiting manner, the centrifugal impeller of the present invention can be used in ventilators and blowers of medium and high peripheral speed which can be up to 400 meters per second, for example.

Figure 1:
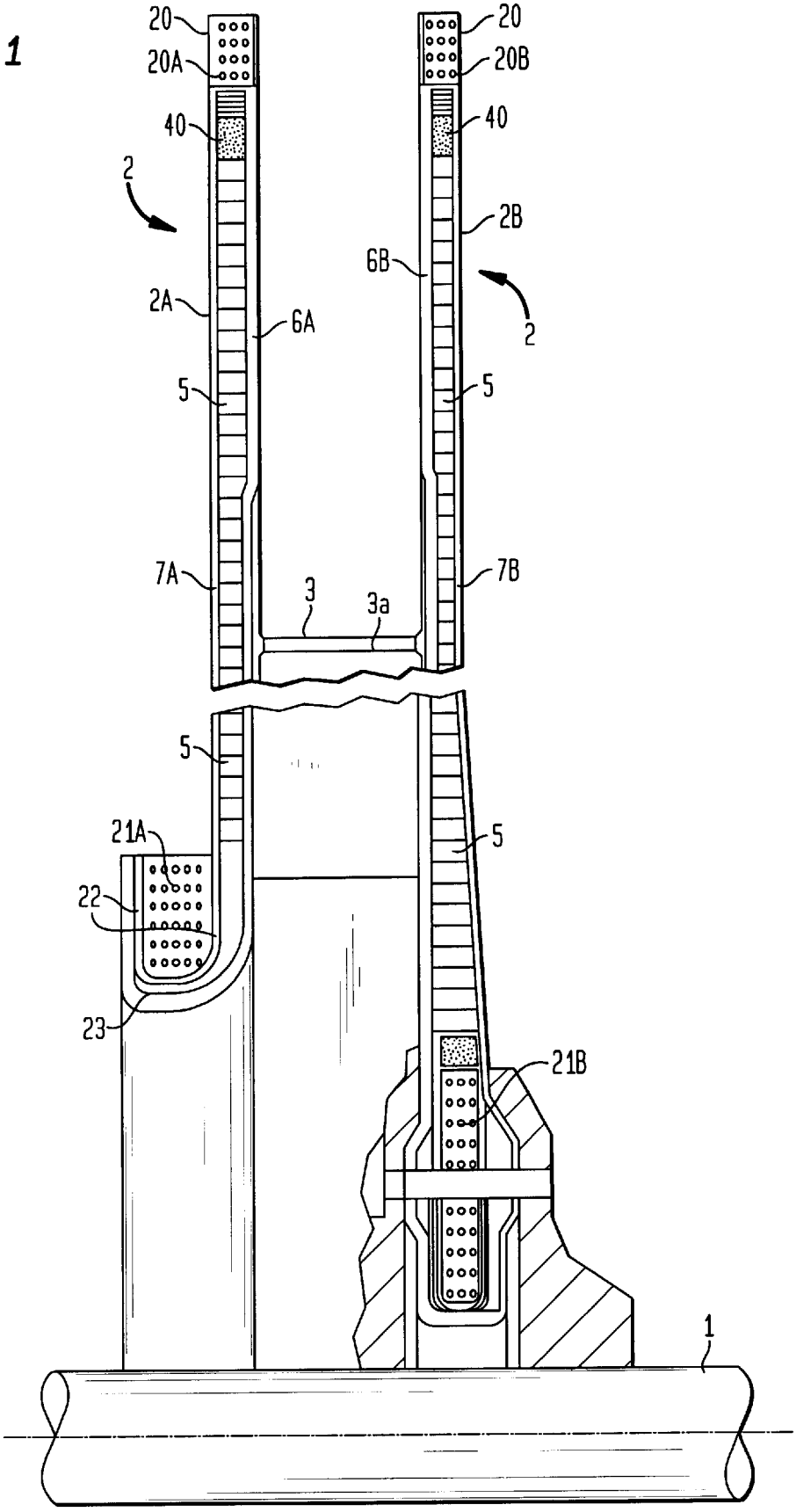
FIG. 1 is a front, perspective view of a centrifugal impeller of the present invention.
Figure 1A:
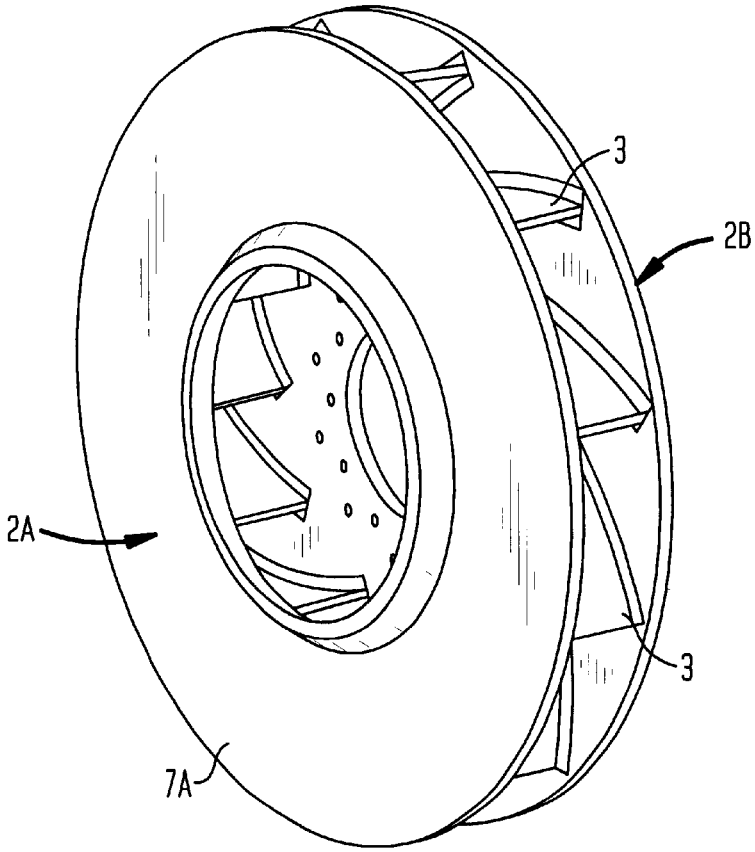
FIG. 1A is a front, perspective, sectional view of the centrifugal impeller of the present invention shown in FIG. 1.

The centrifugal impeller as shown in FIGS. 1 and 1A is produced from conventional composite materials that are known per se and can be mounted by means of a hub or a counter-hub (see FIG. 5) on a rotational axle, 1, defining a rotary axis. In a conventional manner, the impeller or blower is connected to a drive system, that is not shown in the FIGURES.

FIGS. 1 and 1A show the centrifugal impeller of the present invention including a support structure comprising at least two disks, 2, coaxial with the rotational axis, these two disks being mounted facing each other in substantially parallel planes to clamp and fix between them, for example by bonding, a series of ventilation vanes, 3, which are also preferably produced from composite materials. Thus vanes, 3, form crosspieces between disks, 2A and 2B, that clamp and fix said vanes, 3.

In the embodiment shown in FIGS. 1 and 1A, the centrifugal impeller comprises an inlet disk, 2A, and a rear disk, 2B, with identical peripheral diameters, for example of the order of about 1690 millimeters. Clearly, disks, 2A and 2B, can have different diameters depending on the configuration and the intended use of the impeller. In accordance with the present invention, disks, 2A, 2B, can be substantially planar disks or they may be non-planar disks and may, for example, be substantially in the form of a truncated cone.

In accordance with the present invention, the centrifugal impeller comprises disks, 2A, 2B, associated with a sandwich material, 5, (see FIGS. 1 to 4) having good compressive strength, the sandwich material preferably being incorporated into each disk, 2A and 2B, to fill the intermediate zone of disks, 2, by forming the core of each disk and thus excluding the peripheral portion of the disks and the central portion surrounding the rotational axis, 1.

In a preferred embodiment of the present invention, as shown in FIGS. 1 to 4, each disk, 2A and 2B, is formed by an assembly of two skins of composite materials respectively forming an inner skin, 6A and 6B, and an outer skin, 7A and 7B, for each disk, 2A and 2B. The sandwich material, 5, is incorporated between each pair of skins, 6A and 7A, and 6B and 7B.

Figure 3:
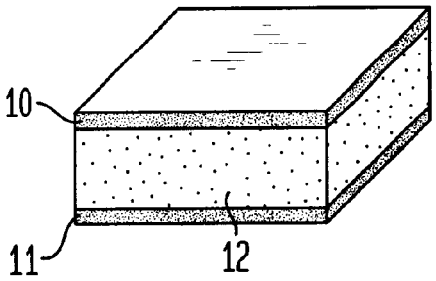
FIG. 3 is a side, perspective, partial cross-sectional view of an example of a sandwich material which forms a portion of the support disk shown in FIG. 2.
Figure 4:
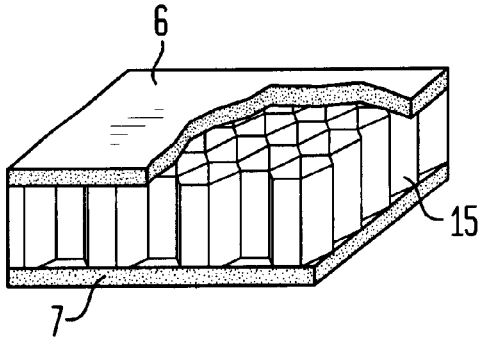
FIG. 4 is a side, perspective, partial cross-sectional view of another example of a sandwich material which forms a portion of the support disk shown in FIG. 2.

The sandwich material, 5, can equally be a sandwich material with a solid core as shown in FIG. 3 or a sandwich material with a hollow core as shown in FIG. 4, with a thickness which varies depending on the size of the impeller, for example of the order of about 20 mm thick for the disk dimensions mentioned above. The density of the foam is advantageously of the order of about 50 to 70 kg/m$^3$.

Thus, the solid core sandwich material can comprise two or more outer layers, 10 and 11, of laminated material and a core, 12, based on a polyurethane type foam and/or a resin which may or may not be filled.

The hollow core sandwich material can advantageously be produced in the form of a honeycomb of aluminum, 15, directly or indirectly incorporated between the respective inner skin, 6 and 7, the axis of the honeycomb being directed substantially perpendicularly to the general plane of each disk, 2.

In accordance with the present invention, the impeller support structure formed by the pair of disks, 2, is produced from composite material skins, 6 and 7.

In a particularly advantageous embodiment of the present invention, each skin, 6 and 7, is formed by a stack of a plurality of "prepreg" plies, 60 and 70, (see FIGS. 11 to 13) of synthetic fiber fabric, which are known per se, forming reinforcing layers of fabric which can be formed from carbon fibers, glass fibers or from KEVLAR brand fibers or aramid fibers or any other equivalent material, each layer being impregnated with epoxy resin, for example.

In a preferred embodiment of the present invention, the stiffness of each disk, 2, is improved by producing each skin, 6 and 7, from a stack of a plurality of plies, 60 and 70, each ply being constituted by a series of radial sections, 61, (see FIG. 2) with angles of substantially 20 degrees, for example. Each radial sector, 61, is placed side by side, partially overlapping the immediately adjacent neighboring sector during a draping operation after first having been cut out using a specific template. In order to ensure that the strength of the structure is homogeneous, the different sectors are cut identically to keep the orientation of the fibers identical.

When the draping operation has been completed, a flexible plastic sheet will hermetically cover the whole assembly and at the same time provide the perimeter of the part with a seal.

A vacuum is then formed underneath the plastic sheet to compress the part and eliminate air bubbles and excess resin that is absorbed by a bleeder.

The stack assembly then undergoes a conventional polymerization cycle in an autoclave with a plurality of overpressure stages associated with temperature cycles that are suitable for the materials being used.

In a particularly interesting variation, the stiffness of the centrifugal impeller can be improved by producing each inner skin, 6A and 6B, with a decreasing thickness in the outward radial direction towards the peripheral zone of each disk, 2. Simultaneously, the thickness of outer skin, 7A and 7B, can remain substantially constant. In general, the thickness of inner skins, 6A and 6B, and outer skins, 7A and 7B, can be either constant or variable. In this latter case they can, for example, be of decreasing radial thickness either on the inner faces or on the outer faces or simultaneously on both faces.

The general strength of the centrifugal impeller of the present invention is also improved by producing stiffening rings intended to take up all or a portion of the centrifugal forces resulting from rotation of the impeller. To this end, each disk, 2A and 2B, forming an impeller of the present invention comprises an exterior collar, 20A and 20B, formed at the periphery of each disk, 2A and 2B.

The impeller of the present invention also comprises an interior collar, 21, comprising two collars individually associated with each disk, 2A and 2B, and denoted by reference numerals, 21A and 21B, respectively.

Interior collars, 21A and 21B, and exterior or peripheral collars, 20A and 20B, are produced from filament windings including strong reinforcing fibers, for example carbon fibers, bonded by an epoxy type resin, and depending on the case before or after assembling the impeller structure. These reinforcing fibers are disposed in an alignment that is selected as a function of the tension to which the structure will be subjected. Within the context of the present invention, the term "strong or very strong reinforcing fibers" means any fibers, preferably formed from composite materials but not exclusively formed from composite materials, the mechanical characteristics of which, expressed in terms of the breaking stress, are substantially in the range about 2000 to 4600 MPa. Non-limiting examples that can be cited are glass fibers, carbon fibers or KEVLAR brand fibers or aramid fibers. The diameter of the interior collar, 21A, located at the base of the inlet disk, 2A, is higher than that of the other interior collar, 21B, which is associated with the rear disk, 2B, and is located substantially at right angles to the peripheral collar, 20B, and in the plane of disk, 2B. Interior collar, 21B, is intended to surround impeller axle, 1, and to act as an interface with the hub. In contrast, interior collar, 21A, is preferably in a plane located in front of the plane of disk, 2A.

Figure 2:
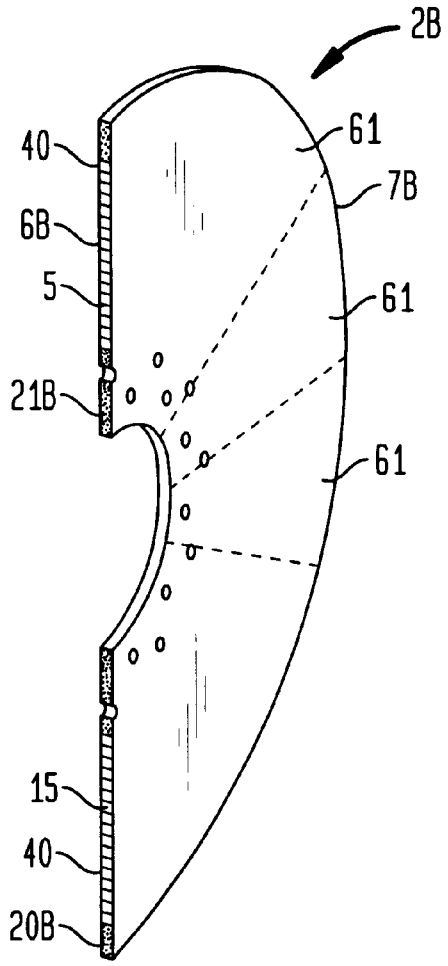
FIG. 2 is side, perspective, partial cross-sectional view of a detail of a support disk which forms part of the impeller shown in FIG. 1.

FIGS. 1 and 2 in particular show that the interior collars, 21A and 21B, and peripheral collars, 20A, 20B, are at least partially held in place by plies of prepregs, 60 and 70, (see FIGS. 11 to 13) each forming the inner and outer skin, 6A and 6B, and 7A and 7B, respectively. Thus interior collar, 21A, is at least partially surrounded, for example, at its two lateral faces, 22, and its lower face, 23, by different plies, 60 and 70, of the inner skin, 6A, and outer skin, 7A. This is also the case for the other interior collar, 21B, and for each peripheral collar, 20A and 20B. Such an arrangement has the clear advantage of ensuring that the assembly is stronger by improving the strength as regards centrifugal forces and by considerably limiting shear due to centrifugal forces between skins, 6 and 7, and sandwich material, 5.

Figure 13:
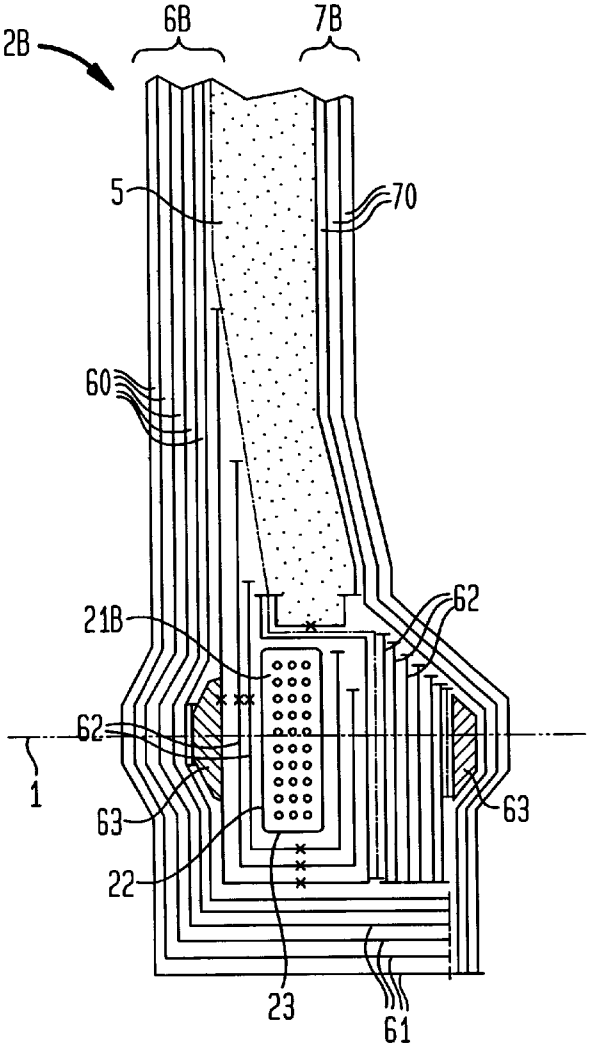
FIG. 13 is a side, elevational, partial cross-sectional view of the structure of yet another impeller of the present invention.
Figure 12:
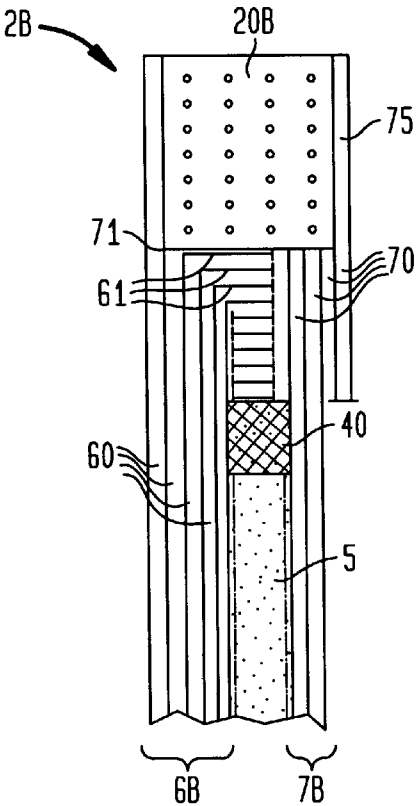
FIG. 12 is a side, elevational, partial cross-sectional view of the structure of another impeller of the present invention.
Figure 11:
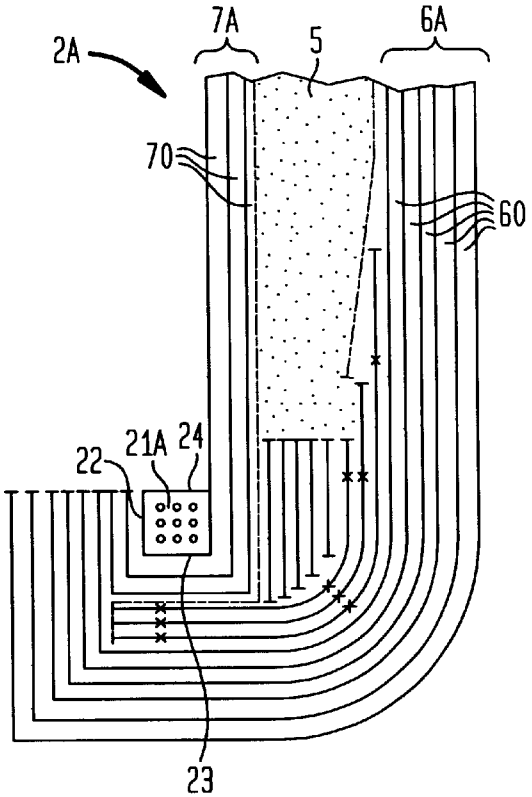
FIG. 11 is a side, elevational, partial, cross-sectional view of the structure of an impeller of the present invention.

FIGS. 11, 12 and 13 show the structure of the stack of plies, 60 and 70, constituting each skin, 6 and 7, in more detail and the manner in which collars, 20 and 21, are held in place by said plies.

FIG. 11 shows how interior collar, 21A, is held in and on inlet disk, 2A. The plies of prepregs, 60, forming the stack leading to the production of inner skin, 6A, completely surround interior collar, 21A, with the exception of its upper face, 24, and cover the plies of prepregs, 70, constituting the outer skin, 7A. Prepreg plies, 60 and 70, principally cover the lower, 23, and lateral, 22, faces of interior collar, 21A. FIG. 12 shows in detail an embodiment of the stack of plies of prepregs, 60 and 70, producing peripheral collar, 20B. Thus, peripheral collar, 20B, is covered at least on its lateral faces by at least one and preferably a plurality of prepregs, 60 and 70, form inner skin, 6B, and outer skin, 7B, respectively. As can be seen in FIG. 12, certain plies of prepregs, 60 and/or 70, can be folded at their terminal ends, 61 and 71, beneath the interior face of peripheral collar, 20B. Further, a partial outer reinforcement can be mounted or bonded to the outer face of peripheral collar, 20B.

FIG. 13 illustrates the production of skins, 6B and 7B, at the interior collar, 21B. As shown, inner skin, 6B, can advantageously be formed from six plies of prepregs, 60, that directly or indirectly surround lateral faces, 22, and lower face, 23, of collar, 21B. As shown in FIG. 13, it is possible to use plies of prepregs, 62, which are in the form of strips with reduced dimensions and lengths to constitute a stack and a point reinforcement of the collar at the rotational axis, 1, in the immediate vicinity of collar, 21B, in addition to skins, 6B and 7B. Advantageously, two prefabricated peripheral crowns, 63, are included in the draping constituted by two skins, 6B and 7B, to reinforce the structure around rotational axis, 1. Skin, 7B, and its constituent plies, 70, reinforce the outer face of disk, 2B, and form a bond and joint with end, 61, of the plies of prepregs, 60, which surround the lower face, 23, of collar, 21B.

Such a configuration of the assembly of plies of prepregs, 60 and 70, can guarantee that the impeller structure is strong as regards forces, in particular centrifugal forces, and marries lightness with stiffness under tension and bending.

Figure 6:
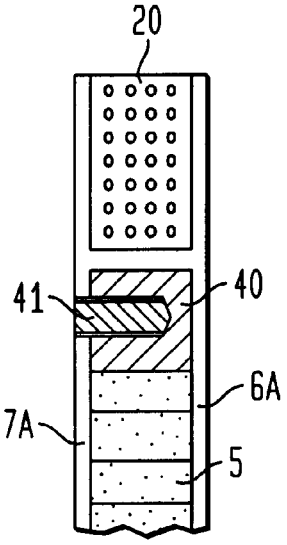
FIG. 6 is a front, elevational, partial cross-sectional view of a balancing device used in a disk of the centrifugal impeller of the present invention.

Advantageously, each impeller is balanced at each disk, 2A and 2B. Thus each disk, 2A and 2B, comprises an annular balancing zone, 40, produced from a material that can be perforated, either a synthetic foam or a reinforced or non-reinforced resin. The balancing zone, 40, is in the form of a ring of synthetic material located at the periphery, and for example in the immediate vicinity of the sandwich material, 5, and between the latter and the peripheral collar, 20A and 20B, and/or plies of prepregs, 60 and 70, located underneath the lower face of peripheral collar, 20A and 20B. FIG. 6 in particular shows that the impeller can then be balanced at a fixed radius from the periphery of the impeller, by directly puncturing the annular balancing zone, 40. It is possible to inject resin into the blind hole obtained (see FIG. 6) to produce structural bonding of the puncture, then a piece of lead, 41, is inserted. It is thus possible to balance the impeller using several point masses disposed at different radial positions.

Figure 5:
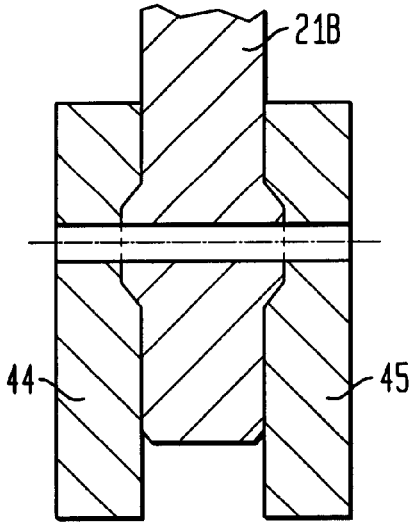
FIG. 5 is a front, elevational, partial cross-sectional view of a portion of the centrifugal impeller of the present invention.

FIG. 5 shows the means by which the impeller can be fixed on the rotational axis entrained by a motor. As an example, the impeller can be fixed by means of a hub, 44, and a counter-hub, 45, both shaped to match that of the interior collar, 21B, to clamp the latter. It can be fixed by a simple bolt connection. A mounting clearance between the collar, 21B, and hub, 44, and between the counter-hub is advantageously provided so as to guarantee centering by the impeller bearing on the hub, 45, without introducing a compressive force due to centrifugal force.

Figure 7:
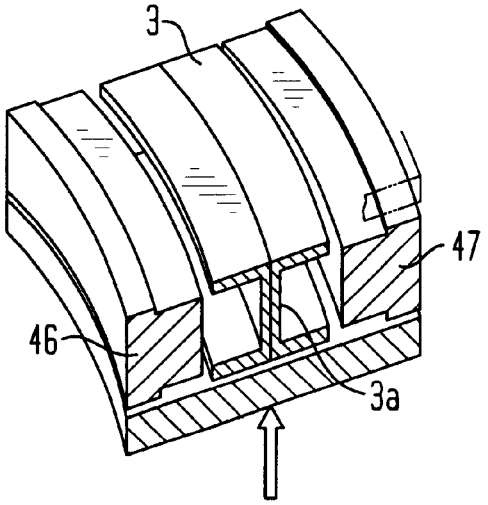
FIG. 7 is a side, perspective, partial cross-sectional view of a vane for incorporation into an impeller of the present.

The impeller of the present invention also preferably comprises a series of vanes, 3, formed from composite materials and obtained using a conventional vacuum molding technique using an autoclave. Thus vanes, 3, are produced by molding from a mold, 46, and counter-mold, 47, to produce each vane, 3, individually (see FIG. 7). In FIG. 7, mold, 46, and counter-mold, 47, have been shown in the demolding position to show a vane that has just been molded. Advantageously, the cross-section of vanes, 3, is substantially H-shaped to facilitate mounting of guards on the under pressure face or the pressure face of the two faces of the core, 3*a*, of each vane, 3. Mounting guards can be particularly suitable when the impeller is to be used under conditions or in processes that are particularly abrasive or aggressive for the materials from which vanes, 3, are composed. Such conditions are encountered, for example, in mechanical steam compression due to the presence of particles of water in the steam. Further, vanes, 3, may or may not be of constant width. In the latter case, disks, 2, are substantially in the form of a truncated cone.

Figure 8:
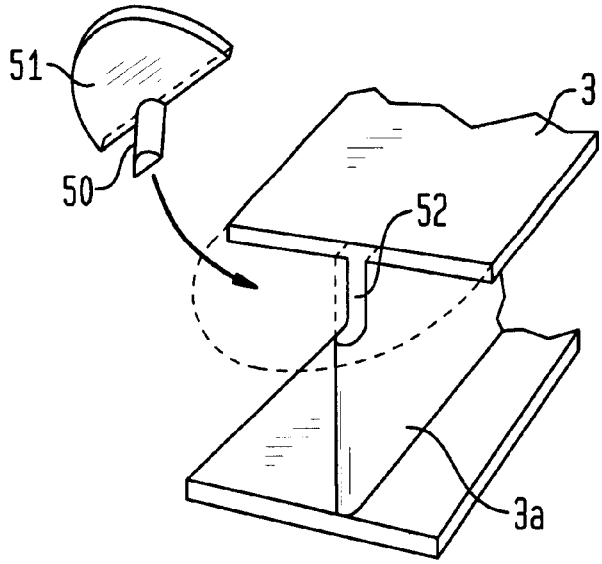
FIG. 8 is a side, perspective, partial view showing the production and mounting of a protective shim on the vanes of an impeller of the present invention.
Figure 9:
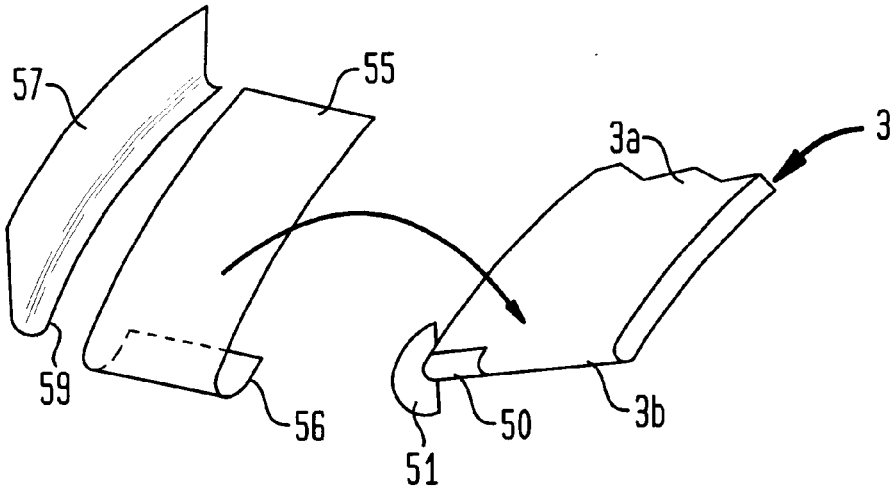
FIG. 9 is a side, perspective, exploded, partial view showing the production and mounting of another protective shim on the vanes of an impeller of the present invention.

FIGS. 8 and 9 show the manner in which vanes, 3, are provided with metal guards, preferably of stainless steel. Thus, the metal guards can comprise a peg surmounted by a semi-circular crown, 51, and intended to be integrated into a depression (not shown in the FIGURES) provided in disk, 2, and into a notch, 52, machined in vane, 3, in particular in the attack edge of cores, 3*a*.

The metal guards can also comprise a first shim, 55, for fixing to the pressure face of vane, 3, namely the upper face of vane, 3. Advantageously, the first shim, 55, is provided with a rolled end edge, 56, to cover the attack edge, 3*b*, of the vane, 3. Preferably, a second rolled edge can be provided to cover the trailing edge of the vane, 3. The protective device also advantageously comprises at least one second metal shim, 57, for fixing to the disk, 2, with a flange, 59, which forms an edge turned over the pressure face of the vane, 3. Shims, 55 and 57, can be affixed by bonding, with or without riveting.

Figure 10:
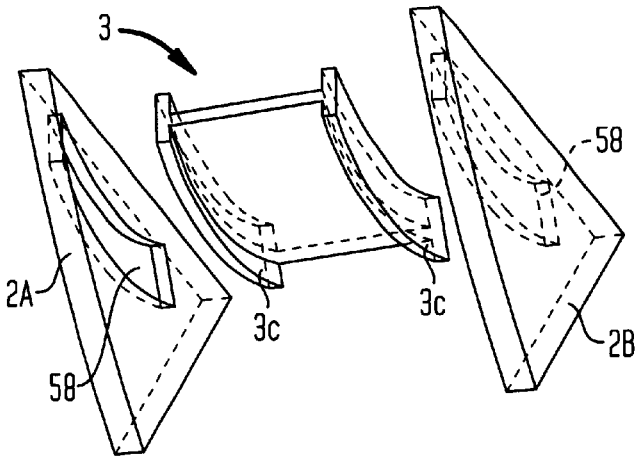
FIG. 10 is a front, perspective, partial, exploded view of a portion of the vanes on the disks of the centrifugal impeller of the present invention.

In order to facilitate positioning and rapid assembly of the ensemble of parts constituting the impeller of the present invention, it is particularly advantageous to form a series of depressions, 58, (see FIG. 10) in the inner faces of each disk, 2A and 2B, i.e., in skins, 6A and 6B. Depressions, 58, are of a shape, direction and configuration which is suitable for vanes, 3, and are intended to receive wings, 3*c*, of vanes, 3, to facilitate their positioning when assembling the pair of disks, 2, and vanes, 3, disposed between said disks, 2. Depressions, 58, allow accurate and rapid positioning of the assembly of vanes, 3, and disks, 2, which can be vacuum bonded in a single operation.

The impeller obtained is a structure which can balance lightness and stiffness both under tension and in bending, while being relatively simple to produce and relatively cheap.

The industrial application of the present invention lies in the production of a composite impeller for a centrifugal ventilator.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An impeller comprising a plurality of vanes, first and second coaxial disks formed from composite material on opposite sides of said plurality of vanes for fixing said vanes in position, each of said first and second coaxial disks including a pair of outer layers and an intermediate zone, said intermediate zone comprising material having improved compressive strength, whereby said impeller rotates about an axis of rotation, and at least one reinforcing collar disposed coaxially with and adjacent to said axis of rotation to provide an interior collar therefor, said at least one reinforcing collar comprising reinforcing filament windings.

2. The impeller of claim 1 wherein said reinforcing fibers comprise carbon fibers.

3. The impeller of claim 1 wherein each of said pair of outer layers comprises an inner skin layer facing said vanes and an outer skin layer facing away from said vanes.

4. The impeller of claim 3 wherein each of said inner skin layers includes a decreasing thickness moving in a direction radially outward from said axis of rotation and each of said outer skin layers includes a substantially constant thickness.

5. The impeller of claim 1 wherein said intermediate zone comprises a solid material.

6. The impeller of claim 1 wherein said intermediate zone comprises a hollow core material having a honeycomb structure.

7. The impeller of claim 3 wherein each of said outer skin layers and each of said inner skin layers comprises a stacked plurality of layers of synthetic fiber material.

8. The impeller of claim 7 wherein each of said stacked plurality of layers comprises a plurality of radial sections, said plurality of radial sections each being partially overlapping with its adjacent radial sections.

9. The impeller of claim 1 wherein said at least one reinforcing collar comprises first and second reinforcing collars associated with said first and second coaxial disks, respectively.

10. The impeller of claim 3 wherein said at least one reinforcing collar is at least partially surrounded by at least one of said outer skin layers and at least one of said inner skin layers.

11. The impeller of claim 1 including a first peripheral collar axially and peripherally disposed on said first coaxial disk and a second peripheral collar axially and peripherally disposed on said second coaxial disk, each of said first and second peripheral collars comprising reinforcing fibers.

12. The impeller of claim 11 wherein said reinforcing fibers comprise carbon fibers.

13. The impeller of claim 11 wherein each of said pair of outer layers comprises an inner skin layer facing said vanes and an outer skin layer facing away from said vanes.

14. The impeller of claim 13 wherein each of said first and second peripheral collars is at least partially surrounded by at least one of outer skin layers and at least one of said inner skin layers.

15. The impeller of claim 11 including a first annular balancing zone peripherally disposed inwardly from said first peripheral collar and a second annular balancing zone peripherally disposed inwardly from said second peripheral collar, said first and second annular balancing zones including a perforatable material.

16. The impeller of claim 15 wherein said perforatable material comprises a synthetic foam.

17. The impeller of claim 1 wherein said plurality of vanes comprises a composite material.

18. The impeller of claim 17 wherein said plurality of vanes have an H-shaped cross-sectional configuration.

19. An impeller comprising a plurality of vanes, first and second coaxial disks formed from composite material on opposite sides of said plurality of vanes for fixing said vanes in position, whereby said impeller can rotate about an axis of rotation, and at least one reinforcing collar disposed coaxially with and adjacent to said axis of rotation to provide an interior collar therefor, said at least one reinforcing collar comprising reinforcing fibers;

said plurality of vanes comprising a composite material and having an H-shaped cross-sectional configuration;

said plurality of vanes including an attack edge, a pressure face and a trailing edge with respect to the direction of rotation of said impeller, and including metal guard members for said plurality of vanes comprising a peg disposed on said attack edge, and a first shim affixed to said pressure face and covering said attack edge of said plurality of vanes.

20. The impeller of claim 19 wherein said first shim also covers said trailing edge of said plurality of vanes.

21. The impeller of claim 19 including a second shim affixed to one of said first and second coaxial disks and including a flange disposed on said pressure face of said plurality of vanes.

22. The impeller of claim 1 wherein said first and second coaxial disks include a plurality of depressions adapted to receive said plurality of vanes in order to facilitate the positioning thereof.

* * * * *

UNITED STATES PATENT AND TRADEMARK OFFICE

CERTIFICATE OF CORRECTION

PATENT NO. : 6,402,467 B1 
DATED : June 11, 2002
INVENTOR(S) : Alain Godichon and Sylvain Georges Raymond Guillemin It is certified that error appears in the above-identified patent and that said Letters Patent is hereby corrected as shown below:

Column 4,
Line 11, “present:” should read -- present invention: --

Column 7,
Line 21, “form” should read -- forming --

Column 10,
Line 10, “one of outer” should read -- one of said outer --

Signed and Sealed this

Thirtieth Day of July, 2002

*Attest:*

*Attesting Officer*

JAMES E. ROGAN
*Director of the United States Patent and Trademark Office*